US005577548A

United States Patent [19]

Hohenbichler et al.

[11] Patent Number: 5,577,548

[45] Date of Patent: Nov. 26, 1996

[54] CONTINUOUS CASTING PROCESS AND PLANT

[75] Inventors: Gerald Hohenbichler, Enns; Kurt Engel, St. Florian; Andreas Kropf, Puchenau, all of Austria

[73] Assignee: Voest-Alpine Industrieanlagenbau GmbH, Austria

[21] Appl. No.: 322,770

[22] Filed: Oct. 13, 1994

[30] Foreign Application Priority Data

Oct. 14, 1993 [AT] Austria ..... 2066/93

[51] Int. Cl.[6] ..... B22D 11/12

[52] U.S. Cl. ..... 164/452; 164/417; 164/424; 164/476; 164/483

[58] Field of Search ..... 164/476, 452, 164/483, 417, 424

[56] References Cited

U.S. PATENT DOCUMENTS 4,926,930 5/1990 Gay et al. ..... 164/476

FOREIGN PATENT DOCUMENTS 0450391 10/1991 European Pat. Off. .
0545104 6/1993 European Pat. Off. .
1583620 8/1970 Germany .
60-21150 2/1985 Japan ..... 164/476
61-245952 11/1986 Japan ..... 164/452
62-13250 1/1987 Japan ..... 164/452
63-180351 7/1988 Japan ..... 164/476
63-242452 10/1988 Japan ..... 164/452
5-69088 3/1993 Japan ..... 164/476

*Primary Examiner*—J. Reed Batten, Jr.
*Attorney, Agent, or Firm*—Ostrolenk, Faber, Gerb & Soffen, LLP

[57] ABSTRACT

In continuous casting in a continuous casting plant, a strand (2) after emergence from the mold (1) is reduced in thickness by a wedge-shaped roller gap. In order to assure upon the casting to obtain the shortest possible wedge-shaped solidified head piece (25) or in the event of an interruption in casting or a decrease in the operating casting speed a short completely solidified strand intermediate piece of a thickness (28) differing from the desired final thickness (26) of the strand, the strand (2) is reduced in thickness exclusively in a region in which it has a liquid center (20), support segments (4, 5) being so directed at all times that the liquid tip (19) of the liquid center (20) always lies in a region of the strand guide in which the roller gap developed by the rollers (8) is the narrowest parallel gap—with respect to the following strand guide and disregarding a roller adjustment which follows the shrinkage of the completely solidified strand.

16 Claims, 5 Drawing Sheets

$\alpha_1 > \alpha$
$\alpha_1 > \alpha$
$\alpha$
$\alpha$
$\alpha$
$\alpha$
I
I
II I
II
4
5
6
2
19
20
24
26
28
29
α
$v_g$
$v=0$
$v_1=0$
$v_2$
$v_3 < v_2$ I
II
1
2
4
5
6
19
20
24
26
28
29
α
α1
α2
V1<Vg
V2>V1
V3<V2
Vg

CONTINUOUS CASTING PROCESS AND PLANT

BACKGROUND OF THE INVENTION

The present invention relates to a process for continuous casting in a continuous casting plant, in particular a steel continuous casting plant, having a continuous casting mold and a strand guide which is arranged below the discharge opening of the continuous casting mold and has rollers which support the strand on opposite sides, at least the rollers which are associated with one side of the strand being mounted on support segments which are displaceable with respect to the opposite rollers, the strand being reduced in thickness after its emergence from the mold in the manner that at least one support segment is so aligned as to form a predetermined wedge-shaped roller gap between the rollers which lie opposite each other.

In order to improve the quality of the strand, it is known to reduce the thickness of the strand directly upon its emergence from the continuous casting mold—and therefore while its core is still liquid. In order to carry out this thickness-reducing process in which the strand is reduced, for instance, from a thickness of 70 mm to a thickness of about 60 mm, it is known (EP-A 0 450 391 or DE-A 1 583 620) to establish a wedge-shaped roller gap on the strand guide. The strand, the shell of which is very thin directly below the continuous casting mold, is thereby imparted a reduction in thickness, known in the literature as a "soft reduction". In order to avoid a breaking of the strand, the zone over which a wedge-shaped roller gap is provided extends over a long length so that the strand is actually reduced in thickness as softly as possible.

From EP-A 0 545 104, a process for the continuous casting of slabs is known in which the strand is subjected to a soft reduction. In that known process, the strand travels into the path where the soft reduction is effected while it still has a liquid phase. At the end of the soft-reduction path, the strand is completely solidified. In this way, an improvement in the internal quality is to be obtained in the region of the remaining solidification, and segregations are avoided in the strand. In this case, there is the disadvantage that if the tip of the liquid center of the strand is present within the soft-reduction path, excessive forces occur between the rollers which shape the strand and the strand itself, which can lead to damage to the soft-reduction path, and particularly the rollers thereof.

The requirement that the wedge-shaped roller gap should have the greatest possible length for a soft shaping of the strand is opposed by the requirement that the strand be shaped only when it has a liquid center insofar as, particularly in the case of thin cast strands, the liquid center extends only over a relatively short length and a reduction in the casting speed can have the result that the tip of the liquid core comes into a position within the zone in which a wedge-shaped roller gap is set. In this way, excessive rolling forces can result by which the rollers which form the wedge-shaped roller gap or their roller bearings can be damaged. Another disadvantage which results from a long length of the wedge-shaped roller gap is that, upon casting, a relatively long so-called head piece of the strand is produced the thickness of which does not correspond entirely to the desired final thickness of the strand. One is forced, upon the start of the continuous casting plant, to use a dummy strand the thickness of which is adapted to the dimensions of the continuous casting mold, which, in turn, means that the strand guide must initially be set to the thickness of the dummy strand and that this thickness can only gradually be reduced by the formation of a wedge-shaped roller gap to the desired final thickness. From this, there results a solidified head piece of wedge shape, which can only constitute scrap.

BRIEF DESCRIPTION OF THE DRAWING(S)

FIG. 1 diagrammatically shows a part of a strand guide arranged below a continuous casting mold, partially in section;

FIGS. 2*a* to 2*e* show the casting of a strand in accordance with the present invention.

FIG. 3 is a graph, corresponding to the process shown in FIG. 2, of the withdrawal speed with respect to time.

FIGS. 4*a* to 4*f* and 5*a* to 5*g* each show a variant of the process of the invention as it is carried out when the tip of the liquid center of the strand passes into the wedge-shaped roller gap.

SUMMARY OF THE INVENTION

The purpose of the present invention is to avoid these disadvantages and difficulties, and its object is to create a process of the above-mentioned type, as well as a plant for the carrying out of this process, in which there is obtained the shortest possible wedge-shaped solidified head piece despite the softest possible shaping of the strand, and which make it possible, even in case of an interruption of the casting or a reduction in the operating speed of the casting (as a result of a change in the casting tube or of the distributor, etc.), again to reach the operating casting speed within the shortest possible period of time, with the production of only a short completely solidified strand intermediate piece of a thickness differing from the desired final thickness of the strand (and with wedge-shaped longitudinal cross section).

The object is achieved, in accordance with the invention, in the manner that the strand is reduced in thickness exclusively in a region in which it has a liquid center, the support segments being so directed at all times that the tip of the liquid center always lies in a region of the strand guide in which the roller gap formed by the rollers is developed as a closely parallel gap with respect to the following guidance of the strand (disregarding a roller adjustment which follows the shrinkage of the completely solidified strand) in which connection, advantageously, in order to reach the operating casting speed from a standstill in operation or from a slower casting speed, a decrease of the casting speed, with backward travel of the tip of the liquid center, is effected after an initial increase of the casting speed with forward travel of the tip of the liquid, and only then is the casting speed increased to the operating casting speed, with, once again, forward travel of the tip of the liquid.

By the decrease in the casting speed, which would seem to contradict the requirement of the shortest possible head piece with incomplete reduction in thickness (in the case of the casting) and of the shortest possible strand intermediate piece with unequal thickness (in the case of an interruption in casting, etc.), the result is obtained that the tip of the liquid center again travels in the direction towards the continuous casting mold. As a result, it is possible to bring the support segments into the position adapted to the desired final thickness of the strand after passage of a shorter piece of strand than without this reduction in the casting. By this measure it is possible to keep completely solidified pieces of wedge shape strand particularly short, and to do so only after a brief casting time.

When the tip of the liquid center of the strand reaches the wedge-shaped roller gap, the process of the invention is characterized, in accordance with a first variant, by the fact that, first of all, the support segment which supports the tip of the liquid phase and the other support segments are arranged in parallel-gap position at at least the size of the thickness of the completely solidified strand at the place of the tip of the liquid phase;

that further casting is carried on with relatively high casting speed, the tip of the liquid phase again traveling beyond at least the first support segment which is in parallel-gap position but normally in operating wedge-gap position;

that at least said last-mentioned support segment is again brought into a wedge-gap position;

that at least one support segment which directly adjoins the support segment or segments which have been brought again into wedge-gap position is brought into a parallel-gap position with a thickness corresponding to the operating parallel-gap position;

that, thereupon, the casting speed is reduced so that the tip of the liquid phase travels back to the first support segment in casting direction which has been brought in parallel-gap position with a thickness corresponding to the operating parallel-gap position;

whereupon the casting speed is increased, with advance of the tip of the liquid phase, to the operating casting speed, and the operating wedge-gap position—insofar as not already reached—is established, and the remaining supporting segments are gradually set at the narrowest roller gap which is determined by the operating wedge-gap position.

In accordance with a second suitable variant, it is possible to keep completely solidified wedge-shaped strand pieces even shorter. This method is characterized by the fact that, first of all, the support segment supporting the tip of the liquid phase, together with other the support segments, are directed in parallel-gap position at at least the size of the thickness of the completely solidified strand at the place of the tip of the liquid phase;

that casting is continued with relatively high casting speed, the tip of the liquid phase again traveling beyond at least the first support segment present in parallel-gap position, but normally in operating wedge-gap position;

that at least the last-mentioned support segment is brought into a parallel-gap position with a thickness corresponding to the operating parallel-gap position, that, thereupon, the casting speed is reduced so that the tip of the liquid phase travels back to the first support segment in casting direction which has been brought into parallel-gap position with a thickness corresponding to the operating parallel-gap position, whereupon the casting speed is increased, with forward travel of the tip of the liquid phase, to the operating casting speed, and the operating wedge-gap position is set and the remaining supporting segments are set one after the other to the narrowest roller gap which is determined by the operating wedge-gap position.

For the further shortening of the strand which has solidified in wedge shape, at least one of the support segments is brought into a wedge-gap position which has a greater wedge angle than the operating wedge-gap position and is brought to the operating wedge-gap position only upon the final increase to the operating casting speed.

One advantageous process for the casting of the strand onto the dummy strand head of a dummy strand is characterized by the fact that upon the casting of the strand onto the dummy strand head of a dummy strand and upon the withdrawing of the dummy strand, first of all, all support segments are aligned in a parallel-gap position with a position corresponding to the thickness of the dummy strand head and accelerated to a high casting speed;

that, after the passing of at least one support segment lying first in the casting direction in the region of the operating wedge-gap position by the tip of the liquid phase, at least this first support segment is brought into a wedge-gap position and at least one support segment directly adjoining the support segment or segments brought into wedge-gap position, after being passed by the tip of the liquid phase, are brought into parallel-gap position with a thickness corresponding the operating parallel-gap position;

that, thereupon, the casting speed is reduced so that the tip of the liquid phase travels back at least to the first support segment in the casting direction which has been brought in parallel-gap position with a thickness corresponding to the operating parallel-gap position, thereupon the casting speed is increased, with forward travel of the tip of the liquid phase, to the operating casting speed, and the support segments are placed in operating wedge-gap position—insofar as this has not been previously reached—and one after the other into operating parallel-gap position.

A further shortening of the wedge-shaped head piece is advantageously obtained in the manner that at least one of the support segments is brought into a wedge-gap position having a larger wedge angle than the operating wedge-gap position and is brought to the operating wedge-gap position only upon final increase to the operating casting speed.

Very short pieces of strand with a thickness different from the desired size can advisedly be obtained in the manner that the casting speed is decreased to at least two-thirds of the operating casting speed, the casting speed being advantageously decreased for a short time to at least half of the operating casting speed and then increased to a somewhat higher casting speed which, however, does not exceed two thirds of the operating casting speed, and is held at this casting speed for a short time before increase to the operating casting speed.

Optimal protection of the still incompletely solidified strand can be obtained in this connection in the manner that the numerical value of the speed of setting of a support segment for the reduction of the thickness of the strand is equal to or less than the quotient of the numerical value of the instantaneous casting speed multiplied by the numerical value of half the roller pitch in millimeters, and preferably the entire roller pitch in millimeters.

Intended interruptions in casting and/or decreases in casting speed are preferably limited in time in such a manner that, within the time limitation, the tip of the liquid phase travels back from its operating position assumed by it with the operating casting speed to at most an emergency position at the end—seen in the casting direction—of the operating wedge-gap. In this way, assurance is had that the support segments of the strand guide need not be displaced and that a strand can be produced with constant thickness despite a decrease in the casting speed or an interruption in casting.

A plant for the carrying out the process is characterized by the combination of the following features:

a continuous casting mold, a strand guide adjoining the continuous casting mold and formed of a plurality of support segments with rollers supporting the strand on opposite sides, two or more rollers which are mounted on the support segments, displacement means for adjusting the gap thickness between the rollers facing each other, at least the rollers of one support segment permitting the formation of a wedge-shaped gap in cooperation with the facing rollers, measuring means for measuring the thickness of the gap of the strand guide formed by the rollers, and means for determining the instantaneous position of the tip of the liquid core of the strand.

In a plant of this type, the rollers which support the strand on one side are advantageously fixed, and the rollers which are arranged opposite said rollers and are mounted on support segments can be brought by displaceable support segments, into wedge-gap position or parallel-gap position, at least two of the displaceable support segments being linked to each other in the manner of a link chain.

Other features and advantages of the present invention will become apparent from the following description of the invention which refers to the accompanying drawings.

DETAILED DESCRIPTION OF EMBODIMENTS OF THE INVENTION

Figure 1:
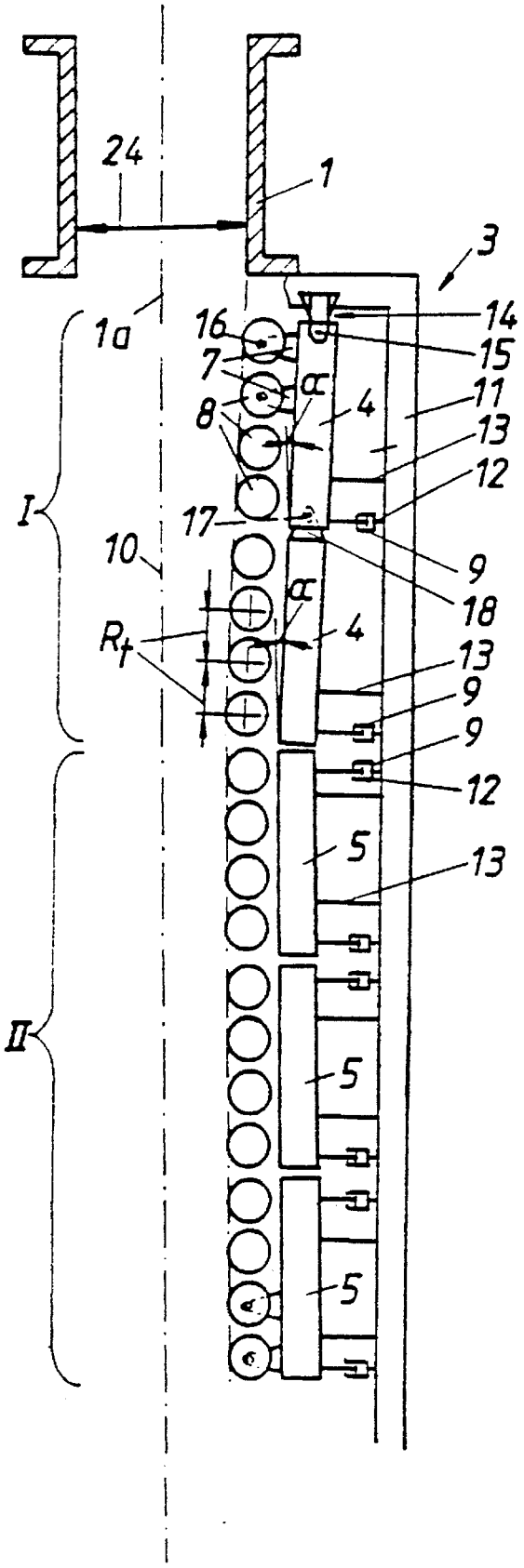

FIG. 1 shows a continuous casting plant suitable for the carrying out of the process of the invention. Below a vertical continuous casting mold 1 having a discharge opening 1*a*, which is developed, in particular, for the casting of a thin strand, of for instance a thickness of 40 to 80 mm, there is arranged a strand guide 3 which has a plurality of support segments 4, 5. In each of the figures, only the support segments 4, 5, which are arranged on one side of the strand 2, shown in FIGS. 2, 4, and 5 (strand surface 6) are shown. The strand 2 is, of course, also supported on the opposite side, there being also arranged on this opposite side support segments which are developed as a mirror image of the support segments 4, 5 shown, or rollers supporting the strand 2 on support segments of any other type or else single-piece rigidly arranged support frames are provided.

Rollers 8 supported on the support segments 4, 5 via roller brackets 7 and arranged with a roller pitch $R_t$ come into direct contact with the surface 6 of the strand. In accordance with the embodiment shown in FIG. 1, four rollers are arranged on a support segment 4, 5. However, a larger or smaller number of rollers 8 can also be provided on each of the support segments 4, 5. The support segments can also be equipped in each case with a different number of rollers 8. Each support segment 4, 5 advantageously has at least two rollers 8.

Each of the support segments 4, 5 is displaceably supported on a rigid support frame 11, which is fixed in position by means of at least one displacement device 9 which permits displacement approximately perpendicular to the surface 6 of the strand and thus perpendicular to the longitudinal axis 10 of the strand. The displacement devices 9 can be operated either hydraulically and therefore by means of compressed-fluid cylinders 12, or be formed by spindles, etc.

For the determination of the position of each support segment 4, 5 with respect to the rigid support frame 11, a measuring device 13 is provided between the support frame 11 and each support segment 4, 5.

In accordance with the embodiment shown in FIG. 1, the first two support segments 4 are linked to each other in the manner of a link chain, the first support segment 4 present below the mold 1 being pivoted on the support frame 11 by a link 14, the pivot pin 15 of which is directed parallel to the axes 16 of the rollers 8. By the linking of the first two support segments 4 to each other in the form of a link chain (the pivot pin 17 of the link 18 which connects the support segments 4 to each other being also directed parallel to the axes 16 of the rollers 8), it is possible in simple fashion, upon displacement of the support segments 4 in the direction towards the opposite rollers (not shown), to avoid jumps where the adjacent support segments 4 abut against each other.

For the setting of different positions of the support segments 4 which are pivoted to each other in the form of a link chain, it is sufficient to provide displacement devices 9 (as well as measuring devices 13) in each case on one end of these support segments 4. For the following support segments 5, which can be set independently of each other and each individually to different strand thicknesses, it is advisable to provide displacement devices 9 and measuring devices 13 on both ends of the a support segment 5.

FIG. 1 shows the support segments 4, 5 in operating position, namely the support segments 4 in operating wedge-gap position (region I), the support segments 4 being each set to one and the same conicity $\alpha$. The following support segments 5 are in operating parallel-gap position (region II), i.e. they are set to the desired thickness of the strand which it is to have during the continuous casting with the operating casting speed $v_g$.

By "operating parallel-gap position" or "parallel-gap position" there is always understood a position of the support segments 4 and 5 in which the strand 2 is in no way reduced in thickness, in which connection however a position of the support segments which is adapted to the shrinkage of the completely solidified strand 2, and therefore a very small conicity setting, can be present, so that continuous contact between the rollers 8 and the surface 6 of the strand is assured.

The object of the invention is, first of all, to obtain the operating position of all support segments 4, 5 after the passage of the shortest possible length of strand, secondly to maintain that position constant, and thirdly, should a deviation of the position of the support segments 4, 5 from the operating position be necessary, to correct this deviation again after passage of the shortest possible length of strand.

The position of the support segments 4, 5 can suitably be set from a control desk or be established by computer in accordance with a given program. For this purpose, the displacement devices 9 and the measuring devices 13 are integrated in a control circuit. In this way, the thickness of the gap formed by the opposite rollers 8 of the strand guide 3 can be continuously monitored and, if necessary, immediately adapted to the existing conditions, in particular in accordance with a predetermined program which can also be brought into dependence on the instantaneous casting speed of $v_m$.

Furthermore, means are provided for determining the instantaneous position of the tip 19 of the liquid core 20 of the strand 2. The means can be formed by a computer in which the instantaneous position of the tip 19 of the liquid core 20 can be determined from various operating parameters, such as the composition of the melt, the temperature of the melt, the casting speed, the cooling (amount of coolant, temperature of coolant), etc. As further means of determining the instantaneous position of the liquid tip 19, a pressure-measuring device, such as a pressure-gauge chamber, can be used.

The casting of the strand 2 onto a starting head 22 of a dummy strand 21 in accordance with the process of the invention will be explained in further detail below. The strand guide shown in FIG. 2 corresponds to that shown in FIG. 1.

The dummy strand 21 has a starting head 22 the thickness 23 which is adapted to the corresponding size 24 of the mold cavity, so that the starting head 22 can easily be sealed-off against the side walls of the mold. All support segments 4, 5 are in a position corresponding to the size 24 of the mold 1, forming a parallel gap with the opposite rollers (FIG. 2*a*).

After the starting head 22 has been introduced into the mold 1 and the gap between the mold side walls 24 and the starting head 22 has been sealed off, the mold is filled with molten metal, whereupon the withdrawal of the dummy strand 21 and the strand 2 which is coupled in traditional manner to the dummy strand 21 is commenced. The speed of withdrawal or casting speed v is increased to a predetermined maximum value, this being done with a relatively high casting speed $v_{10}$, at the time $t_1$ and then held constant at this value $v_{10}$.

Figures 2A, 2B, 2C, 2D, 2E:
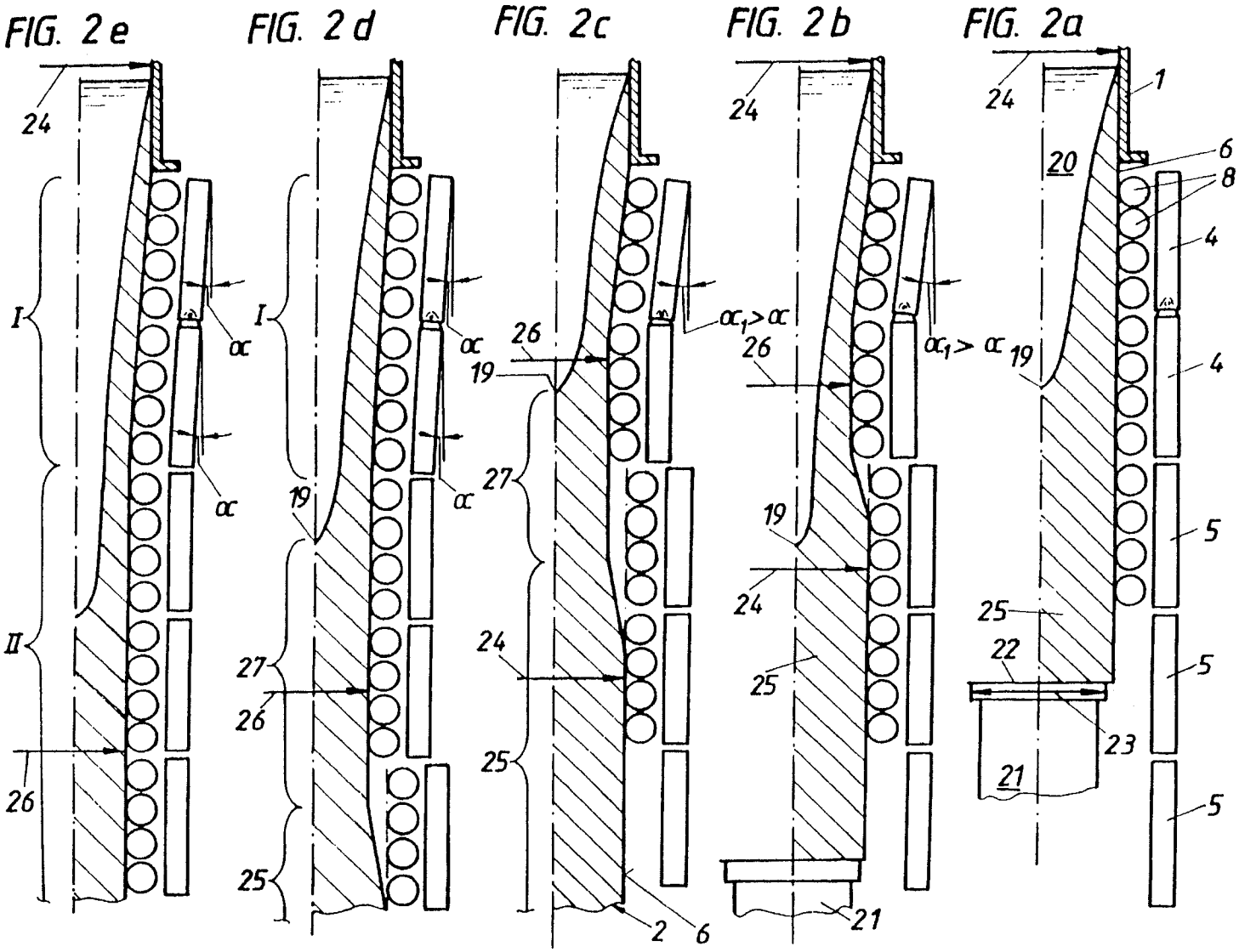

As soon as the tip 19 of the liquid core 20 has passed by at least the first two support segments 4 (time $t_2$), the latter are brought into the position shown in FIG. 2*b*. The first of the two support segments 4 which are linked to each other is brought into a conical position, the conicity $\alpha_1$ being greater than the conicity $\alpha$ which the first two support segments 4 which are later brought into the operating wedge-gap position assume in this wedge-gap position. The second support segment 4 in the direction of withdrawal is brought into a parallel-gap position, namely in a thickness corresponding to the desired thickness 26 of the strand 2. The following support segments 5 are still in the originally set parallel-gap position corresponding to the thickness 24 of the completely solidified strand end 25, the so-called head piece, which is coupled to the dummy-strand head 22.

Figure 3:
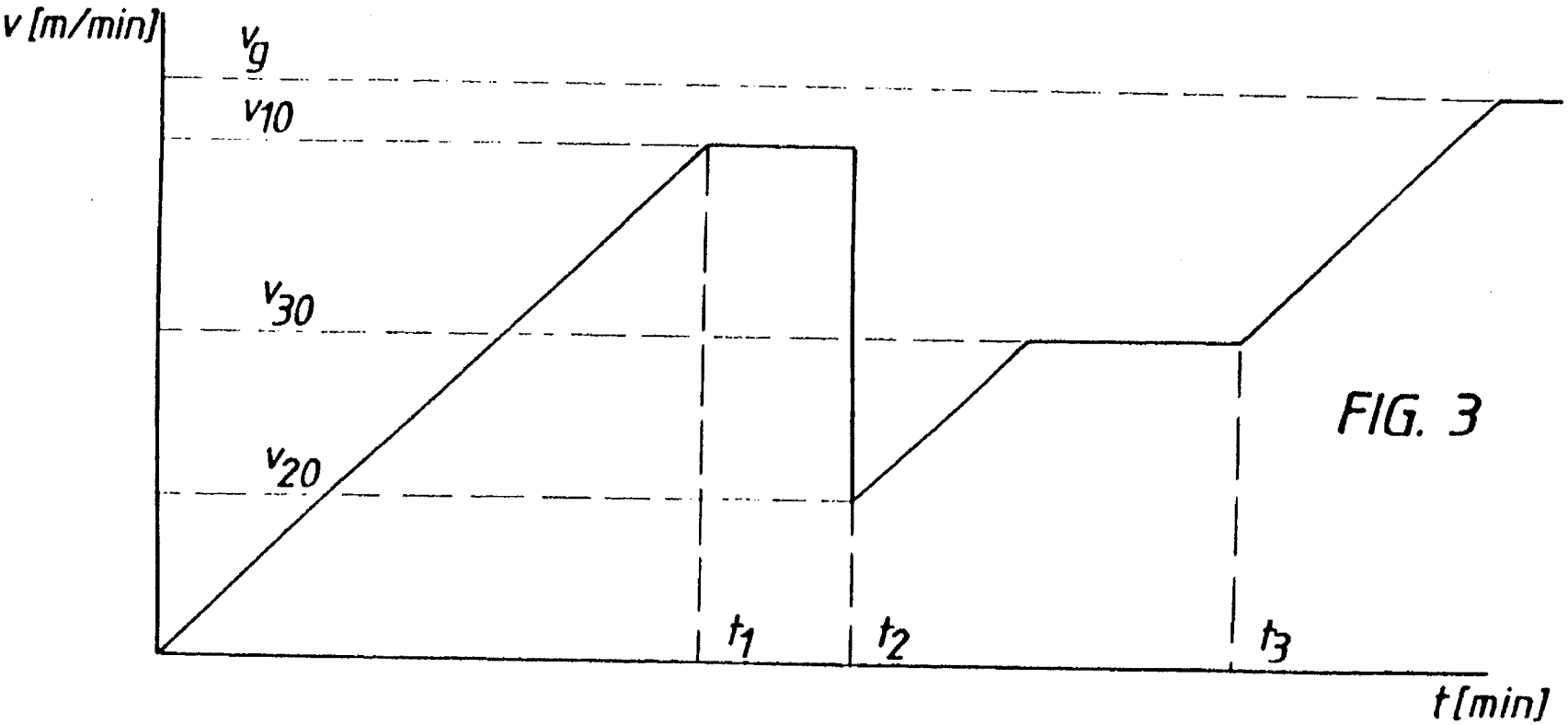

Thereupon, the casting speed is reduced greatly, preferably as rapidly as possible (to the value $v_{20}$ in accordance with FIG. 3) and then increased to the value $v_{30}$ which is less than the value $v_{10}$, so that the liquid tip 19 moves back in the direction towards the mold 1, namely until the tip assumes a position in the region of the first parallelly directed support segment 4 which is already set to the desired strand thickness, 26 (time $t_3$). In this way a completely solidified strand part 27 having a thickness corresponding to the desired thickness 26 of the strand 2 is then formed on the head piece 25, the strand having a length at least corresponding to the length of a support element 5.

Thereupon, the casting speed v is increased to the operating casting speed $v_g$. As soon as the piece of strand 27 which has already been completely solidified in the desired thickness 27 has reached the first of the support segments 5, which are later set to the operating parallel-gap position, this support element 5 can be set to this thickness 26. In this way, the result is obtained that the strand 2 already has a partial piece 27 which is completely solidified to the desired thickness 26 shortly behind the starting head 22, so that the head piece 25 is only very short.

After the liquid tip 19 as shown in FIG. 2*d* has left the two support segments 4 which are to be set in operating wedge-gap position, these segments can be brought from the position shown in FIG. 2*c* into the position shown in FIG. 2*d*, the so-called operating wedge-gap position having the conicity $\alpha$. Upon further casting with the operating casting speed $v_g$, the last support segments 5 which are not yet set to the thickness 26 corresponding to the operating parallel-gap position are finally brought to said position, as shown for the fifth support segment by a comparison of FIG. 2*d* with FIG. 2*e*.

The speed of the reduction of the casting gap, the setting of the position of the support segments 4 shown in FIG. 2*e* from the position shown in FIG. 2*a*, should not be very high so that the shaping and the forces connected therewith are not much higher upon the initial action than upon the subsequent steady-state reduction in thickness (see FIG. 2*e*). A suitable solution for the speed of reduction of the casting gap would be $v_{sp} \leqq 2v_m/R_t$ [m/min], in which $R_t$ is the roller pitch in mm, $v_m$ is the instantaneous casting speed, and $v_{sp}$ is the maximum speed with which at least one roller of the support segment 4 is moved in the direction towards the axis 10 of the strand.

The casting can, however, also be effected with a somewhat softer reduction of the casting gap in the manner that the first two support segments which are linked to each other are brought immediately, without intermediate setting via $\alpha_1$, into the operating wedge-gap position which is shown in FIG. 2*d*; to be sure, the head piece 25 of the strand 2 which passes from the initial thickness 24 to the desired thickness 26 becomes somewhat longer here.

The length of the head piece 25 of the strand 2 which has not been completely reduced in thickness is shorter when the first acceleration selected is greater, namely the increase from a casting speed of zero to a casting speed of $v_1$.

In FIGS. 4 and 5, the process of the invention (in the case of a strand guide having four support segments 4 linked to each other and forming the operating wedge-gap position) is explained for the case which occurs should the tip 19 of the liquid center 20 during continuous operation passes into the wedge-shaped roller gap of the four support segments 4 present in the operating wedge-gap position, and therefore into the region I.

FIG. 4 shows this situation for a complete interruption in casting and therefore a decrease of the casting speed v to zero—in this case the tip of the liquid passes at a greater or lesser distance from the mold depending on the duration of the standstill of the strand. FIG. 5 shows it for the case of a reduction of the casting speed to $v_1 < v_g$; in this case the liquid tip 19 must pass only into the region of the support segment 4 which is last in casting direction is set in operating wedge-gap position. Further backward movement of the liquid tip 19 in the direction towards the mold 1 would in this case be impermissible since the rollers 8 arranged on the conically set support segment 4 would, upon further withdrawal of the strand 2, have to shape a completely solidified strand 2, which could result in damage to the rollers 8.

In the event that backward movement of the liquid tip 19 takes place, the support segments 4 and 5 support the part of the strand 2 which has solidified in wedge shape and, upon the further casting of the strand 2, the support segments 5 are brought into a parallel-gap position which corresponds to the thickness 28 of the strand 2 at the place at which it is first solidified throughout, and therefore at the place where the liquid tip 19 is located. This can take place by tilting of the strand segment 4, the axis of tilt 29 lying at most at a distance from the mold 1 at which the liquid tip 19 is also located. The adjacent support segment 4 which lies further back (and therefore closer to the mold 1) can be brought into a wedge-gap position which is greater than the operating wedge-gap position, i.e., having the conicity $\alpha_1>\alpha$, which is shown in FIG. 5*c*. In accordance with FIG. 4*c*, the parallel positioning of the support segments 4 which are located initially in the operating wedge-gap position is effected by tilting around the pivot axis 17 of the support segment 4 which lies closest to the liquid tip 19, and as a result the support segments 4 which have not been brought into parallel position continue to remain in their operating wedge-gap position with the conicity $\alpha$.

Figures 4A, 4B, 4C, 4D, 4E, 4F:
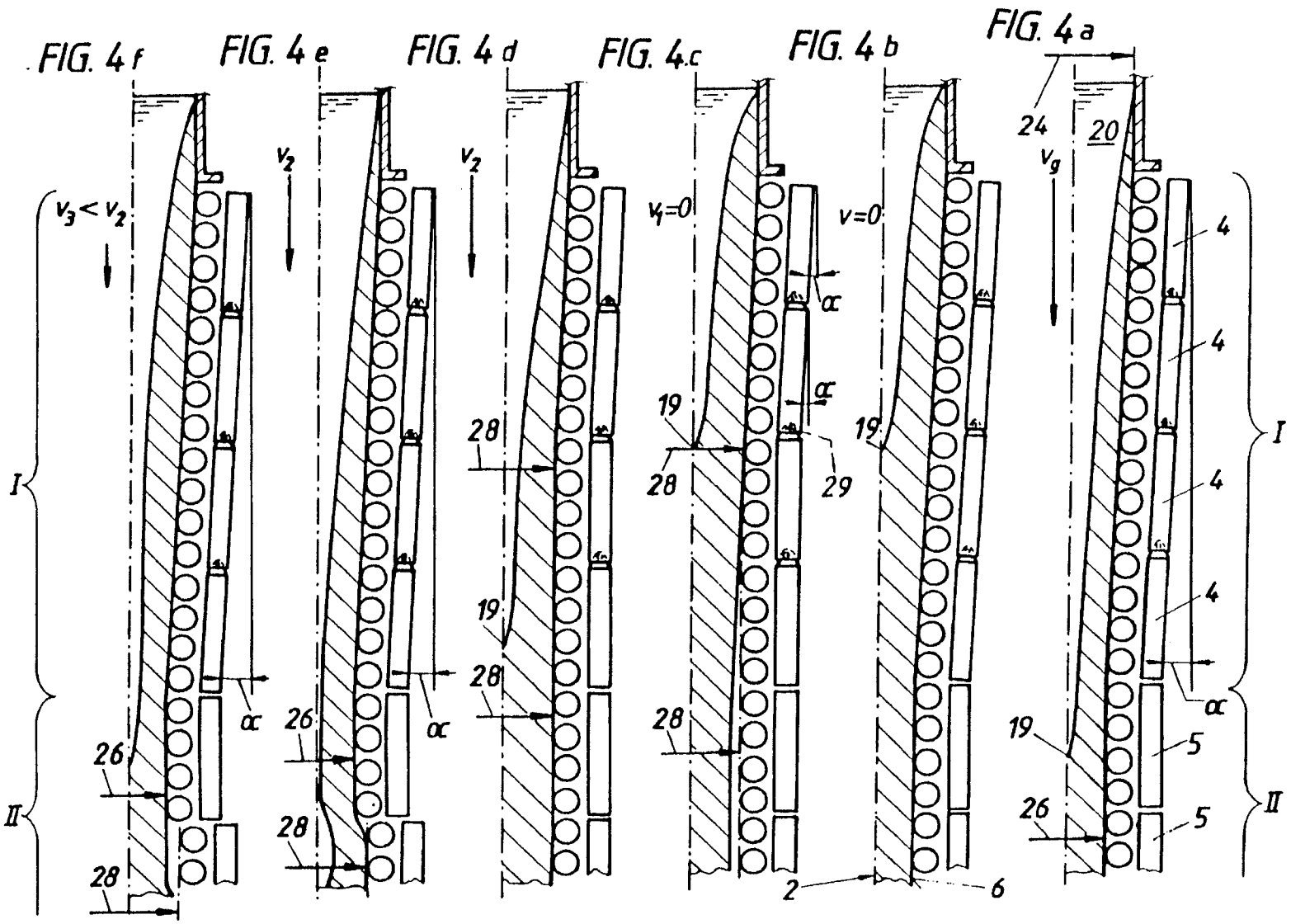
Figures 5A, 5B, 5C, 5D, 5E, 5F, 5G:
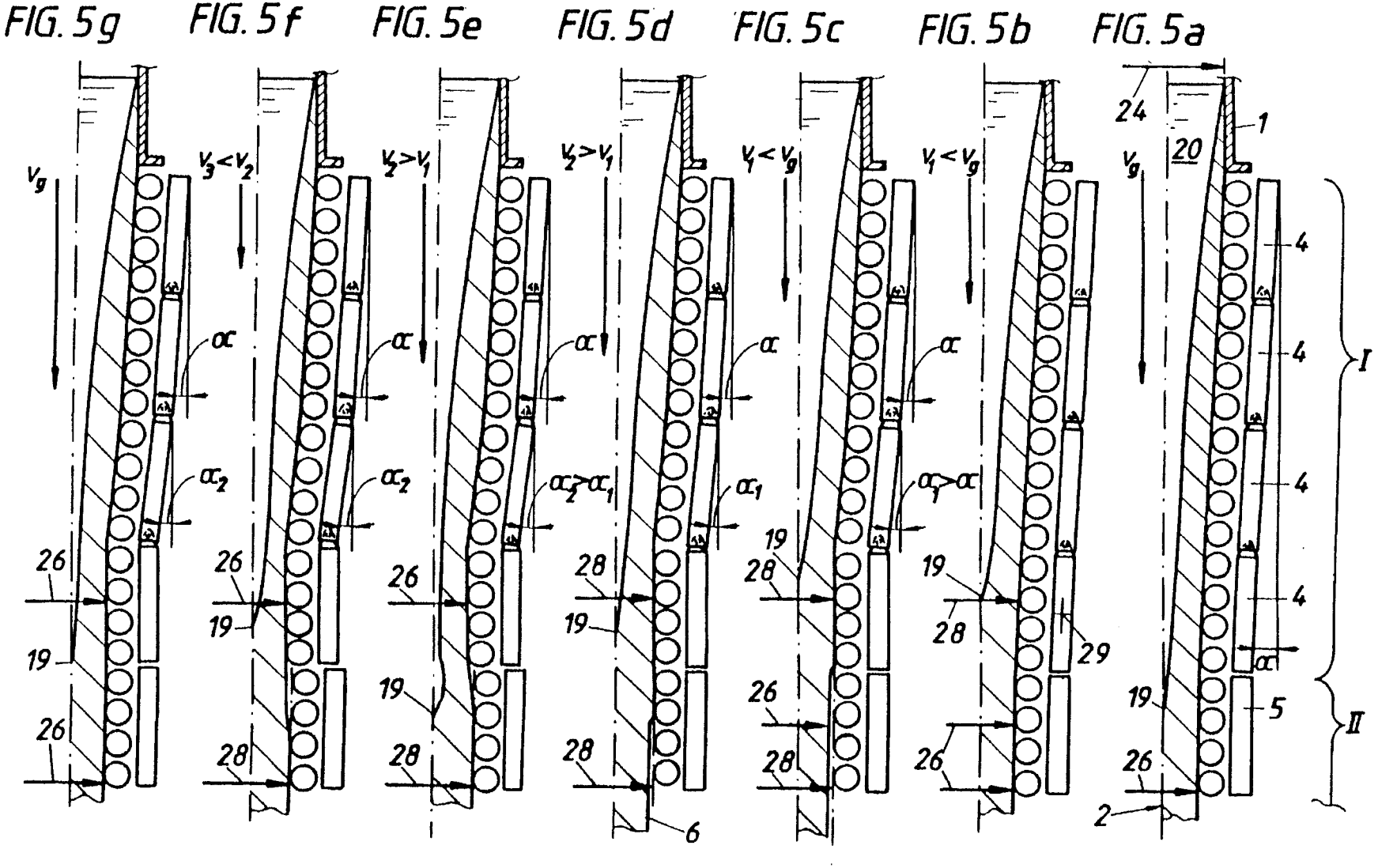

After the placing in parallel, casting is further carried on with relatively high casting speed $v_2$ until the liquid tip 19 again travels beyond at least the first (in casting direction) support segment 4 which has been brought into parallel-gap position (with the thickness 28) but is normally in operating wedge-gap position (see FIGS. 4*d* and 5*d*). Thereupon, either the support segments 4 which have been brought into a position corresponding to the thickness 28 are, as shown in FIG. 4*e*, brought into operating wedge-gap position and the following first support segment 5, which is normally in operating parallel-gap position, is again brought into the operating parallel-gap position (with the thickness 26) or else, as shown in FIG. 5*e*, the first support element 4 in parallel-gap position is brought into a parallel-gap position with a thickness 26 corresponding to the operating parallel-gap position, and the wedge-gap position of the adjacent support segment 4 arranged closer to the mold 1 being increased to the conicity $\alpha_2>\alpha_1$.

Thereupon, the casting speed is reduced as rapidly as possible to the casting speed $v_3$ so that the liquid tip 19 travels back to the support segment 4 or 5 first in the casting direction brought into parallel-gap position with a thickness 26 corresponding to the operating parallel-gap position (see FIGS. 4*f* and 5*f*). In this way, a completely solidified length of strand with the thickness 26 which is to be reduced to that of the strand 2 during normal operation is formed, namely at a very early time and just behind the conically solidified length of strand.

The casting speed is then increased, with again forward advance of the liquid tip 19, to the operating casting speed $v_g$, so that the liquid tip 19 again comes to lie at the distance from the mold shown in FIGS. 4*a* and 5*a*. In this way, the process of FIG. 4 is concluded with the exception of the bringing of the remaining support segments 5 to the thickness 26 corresponding to the operating parallel-gap position during the further casting. For the process shown in FIG. 5, the last two support segments of the support segments 4 which are pivoted to each other must still be brought into the operating wedge-gap position. The following support segments 5 can then also be gradually brought into the operating parallel-gap position (with the thickness 26) upon the further withdrawal or casting of the strand.

As can be noted from the above process description, the support segments are at all times so directed that the liquid tip 19 of the liquid center 20 always lies in a region of the strand guide 3 in which the roller gap formed by the rollers 8 is developed as narrowest roller gap (in which connection, however, the adaptation of the support segments 5 present in the operating parallel-gap position to the shrinkage of the completely solidified strand 2 remains unconsidered, i.e. the only extremely slight conical setting of the support segments 5 present in operating parallel-gap position for the purpose of the contact-of the rollers 8 with the surface of the solidified strand, which is therefore shrinking in the direction of its thickness, is disregarded).

One essential part of the invention is that, after an initial increase in the casting speed with advance of the tip 19 of the liquid, the casting speed is reduced and the liquid tip 19 moves back in the direction towards the mold 1, and only then is the casting speed increased to the operating casting speed $v_g$.

Interruptions in casting and/or reductions in the speed of casting are advisedly limited to a time interval in such a manner that the liquid tip 19 moves from the operating position assumed by it upon operating casting speed back to, at most, the end of the operating wedge gap. Such interruptions in casting or reductions in casting speed may be necessary, for instance, for replacement of the casting tube, replacement of the distributor vessel, etc.

In principle, the process of the invention can also be employed if the rollers of the strand guide are individually displaceable but in that case each roller must be supported with its own displacement device on a support frame and the position of each individual roller must be detectable by means of a measuring device. Linking of the individual support segments to each other is advantageous for the support segments 4 which can be set in operating wedge-gap position. In principle, however, all support segments 4, 5 could be linked to each other in the form of a link chain or also be supported independently of each other on a support frame 11.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A process for continuous casting a strand in a continuous casting plant, having a continuous casting mold (1) provided with a discharge opening (1*a*) and a strand guide with rollers (8) supporting the strand (2) on opposite sides arranged below the discharge opening (1*a*), at least those rollers (8) associated with one side of the strand being mounted on a series of support segments (4, 5) which are displaceable with respect to the opposite rollers (8) said process comprising reducing the strand (2) in thickness after emergence from the mold (1) in the manner that at least the support segment (4) closest to the mold (1) is directed to a predetermined wedge-shaped roller gap having a conicity $\alpha$ between the facing rollers (8), wherein the strand (2) is reduced in thickness exclusively in a region in which it has a liquid core (20), and directing the support segments (4, 5) such that the liquid tip (19) of the liquid core (20) always lies in a region of the strand guide within which the gap formed by the rollers (8) is the narrowest parallel gap disregarding any roller adjustment following the shrinkage of the completely solidified strand.

2. A process according to claim 1, characterized by from a standstill in operation or from a slower speed than the operating casting speed ($V_g$), increasing the casting speed with a corresponding forward travel of the liquid tip (19) in the gap, then reducing the casting speed with the liquid tip (19) moving backward in the gap, and then increasing the casting speed to the operating casting speed ($V_g$) with the liquid tip again traveling forward.

3. A process according to claim 2, characterized by :

when the liquid tip (19) of the liquid core (20) of the strand (2) arrives in the wedge-shaped roller gap, bringing the support segment (4) supporting the liquid tip (19) and the support segments (4, 5) arranged below it in the direction of travel into parallel-gap position at at least the size of the thickness (28) of the completely solidified strand (2) at the place of the liquid tip (19);

carrying on the casting at a casting speed ($V_g$) sufficiently high to cause the liquid tip (19) to travel forward beyond at least the first support segment (4) arranged in parallel-gap position but normally present in operating wedge-gap position;

bringing at least said last-mentioned support segment (4) again into a wedge-gap position;

bringing at least one support segment (4, 5) adjoining the support segment or segments again brought into wedge-gap position into a parallel-gap position having a thickness (26) corresponding to the operating parallel-gap position;

thereupon reducing the casting speed so that the liquid tip (19) moves back to the support segment (4, 5) first in casting direction which has been brought into parallel-gap position with a thickness (26) corresponding to the operating parallel-gap position;

thereupon increasing the casting speed, with forward travel of the liquid tip (19), up to the operating casting speed ($V_g$, and setting the operating wedge-gap position—insofar as not already reached—and gradually bringing the remaining support segments (5) to the narrowest roller gap which is determined by the operating wedge-gap position.

4. A process according to claim 2, characterized by:

when the liquid tip (19) of the liquid core (20) of the strand (2) arrives in the wedge-shaped roller gap, first aligning the support segment (4) supporting the liquid tip (19) together with the support segments (4, 5) arranged below it in parallel-gap position having at least the size of the thickness (28) of the completely solidified strand at the place of the liquid tip (19);

continuing the casting with a casting speed ($V_2$) sufficiently high to cause the liquid tip (19) to travel forward beyond at least the first support segment (4) arranged in parallel-gap position but normally present in operating wedge-gap position;

bringing at least said last-mentioned support segment (4) into a parallel-gap position having a thickness (26) corresponding to the operating parallel-gap position;

thereupon reducing the casting speed so that the liquid tip (19) travels back to the support segment first in casting direction which has been brought into parallel-gap position having a thickness (26) corresponding to the operating parallel-gap position;

thereupon increasing the casting speed, with forward travel of the liquid tip (19), up to the operating casting speed ($V_g$), and setting the operating wedge-gap position and gradually bringing the remaining support segments to the narrowest roller gap which is determined by the operating wedge-gap position.

5. A process according to claim 4, characterized by bringing at least one of the support segments (4) into a wedge-gap position having a larger wedge angle than the operating wedge-gap position and bringing them to the operating wedge-gap position only upon the final increase to the operating casting speed ($V_g$).

6. A process according to claim 3, characterized by bringing at least one of the support segments (4) into a wedge-gap position having a larger wedge angle than the operating wedge-gap position and bringing them to the operating wedge-gap position only upon the final increase to the operating casting speed ($V_g$).

7. A process according to claim 2, characterized by:

upon the casting of the strand onto the starting head (22) of a dummy strand (21) and upon the withdrawal of the dummy strand (21), bringing all support segments (4, 5) into a parallel-gap position with a position corresponding to the thickness (24) of the starting head (22) and effecting acceleration to a high casting speed ($V_{10}$);

after the liquid tip (19) has passed at least one support segment (4) lying first in the direction of casting within the region of the operating wedge-gap position, bringing at least said support segment (4) into a wedge-gap position, and bringing one support segment (4, 5) directly adjoining the support segment or segments (4), which is brought into wedge-gap position after being passed by the liquid tip into parallel-gap position having a thickness (26) corresponding to the operating parallel-gap position;

thereupon reducing the casting speed so that the liquid tip (19) travels back at least to the first support segment (4, 5) in casting direction which has been brought into parallel-gap position having a thickness (26) corresponding to the operating parallel-gap position;

thereupon increasing the casting speed, with forward advance of the liquid tip (19), to the operating casting speed ($V_g$); and bringing support segments (4, 5) into operating wedge-gap position—insofar as not already reached—and gradually directing said segments into operating parallel-gap position.

8. A process according to claim 7, characterized by bringing at least one of the support segments (4) into a wedge-gap position having a larger wedge angle than the operating wedge-gap position, and bringing said support segments to the operating wedge-gap position only upon final increase to the operating casting speed ($V_g$).

9. A process according to claim 2, characterized by decreasing the casting speed to at least two-thirds of the operating casting speed ($V_g$).

10. A process according to claim 9, characterized by decreasing the casting speed briefly to at least half of the operating casting speed ($V_g$) and then increasing it to a somewhat higher casting speed ($V_{30}$) which does not exceed two-thirds of the operating casting speed ($V_g$), and maintaining this casting speed ($V_{30}$) briefly before increase to the operating casting speed ($V_g$).

11. A process according to claim 1, characterized by the numerical value of the speed ($v_{sp}$) of adjustment of a support segment (4) for the reduction of the strand thickness (24, 28) is equal to or less than the quotient of the numerical value of the instantaneous casting speed ($v_m$) multiplied by the numerical value of at least half the roller pitch ($R_t$ in mm).

12. A process according to claim 11, characterized by the speed value is multiplied by a value of at least the entire roller pitch.

13. A process according to claim 1, characterized by an interruption in casting or reduction in speed of casting is so limited in time that, within such time, the liquid tip (19) travels back from its operating position assumed upon operating casting speed to at most an emergency position at the end—seen in casting direction—of the operating wedge gap.

14. A plant for the carrying out of the process according to claim 1, characterized by the combination of:

a continuous casting mold (1);

a strand guide adjoining the continuous casting mold (1) and formed of a plurality of support segments (4, 5), the guide having a plurality of rollers (8) which support the strand (2) on opposite sides;

at least two of said rollers (8) mounted on the support segments (4, 5);

at least one displacement device (9) for adjusting the gap thickness (24, 26, 28) between the rollers (8);

at least the rollers (8) of one support segment (4) permitting the formation of a wedge-shaped gap in cooperation with the facing rollers; at least one measuring device (13) for measuring the thickness of the gap of the strand guide formed by the rollers (8), and means for determining the instantaneous position of the liquid tip (19) of the liquid center (20) of the strand (2).

15. A plant according to claim 14, characterized by the rollers (8) are mounted on support segments (4, 5) movable to wedge-gap position or parallel-gap position.

16. A plant according to claim 15, characterized by at least two (4) of the movable support segments (4, 5) are linked together in the form of a link chain.

* * * * *